US007980295B2

(12) United States Patent
Takamatsu et al.

(10) Patent No.: US 7,980,295 B2
(45) Date of Patent: Jul. 19, 2011

(54) EVAPORATOR AND CIRCULATION TYPE COOLING EQUIPMENT USING THE EVAPORATOR

(75) Inventors: Tomonao Takamatsu, Tokyo (JP); Katsumi Hisano, Matsudo (JP); Hideo Iwasaki, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 429 days.

(21) Appl. No.: 12/114,895

(22) Filed: May 5, 2008

(65) Prior Publication Data

US 2008/0277099 A1 Nov. 13, 2008

(30) Foreign Application Priority Data

May 8, 2007 (JP) ..... P2007-123459

(51) Int. Cl.
*F28D 15/04* (2006.01)
*H05K 7/20* (2006.01)

(52) U.S. Cl. ..... 165/104.26; 165/104.33; 165/147; 361/700

(58) Field of Classification Search ..... 165/80.4, 165/185, 104.26, 104.33, 146–147; 361/689, 361/699–704
See application file for complete search history.

(56) References Cited

U.S. PATENT DOCUMENTS

| | | | | |
|---|---|---|---|---|
| 3,817,321 | A * | 6/1974 | Von Cube et al. | 165/104.22 |
| 5,198,889 | A | 3/1993 | Hisano et al. | |
| 5,436,793 | A * | 7/1995 | Sanwo et al. | 361/689 |
| 6,330,907 | B1 * | 12/2001 | Ogushi et al. | 165/104.26 |
| 6,450,132 | B1 * | 9/2002 | Yao et al. | 122/366 |
| 6,533,029 | B1 * | 3/2003 | Phillips | 165/104.26 |
| 6,564,860 | B1 * | 5/2003 | Kroliczek et al. | 165/104.26 |
| 6,601,643 | B2 * | 8/2003 | Cho et al. | 165/104.26 |
| 6,609,560 | B2 * | 8/2003 | Cho et al. | 165/104.26 |
| 6,651,735 | B2 * | 11/2003 | Cho et al. | 165/104.26 |
| 6,729,383 | B1 * | 5/2004 | Cannell et al. | 165/80.3 |
| 6,766,817 | B2 | 7/2004 | da Silva | |
| 6,918,404 | B2 | 7/2005 | da Silva | |
| 6,994,151 | B2 * | 2/2006 | Zhou et al. | 165/80.4 |
| 7,044,201 | B2 * | 5/2006 | Cho et al. | 165/104.26 |
| 7,066,586 | B2 | 6/2006 | da Silva | |
| 7,168,479 | B2 * | 1/2007 | Hong et al. | 165/104.26 |
| 7,244,398 | B2 | 7/2007 | Kotary et al. | |
| 7,285,255 | B2 | 10/2007 | Kadlec et al. | |
| 2004/0042174 | A1 | 3/2004 | Tomioka et al. | |
| 2006/0012958 | A1 | 1/2006 | Tomioka et al. | |
| 2007/0095506 | A1 * | 5/2007 | Hou et al. | 165/104.26 |
| 2007/0212281 | A1 | 9/2007 | Kadlec et al. | |
| 2007/0292314 | A1 | 12/2007 | Effenhauser et al. | |
| 2008/0015531 | A1 | 1/2008 | Hird et al. | |

FOREIGN PATENT DOCUMENTS

| | | |
|---|---|---|
| JP | 2003-148882 | 5/2003 |
| JP | 3450148 | 7/2003 |
| JP | 2007-163076 | 6/2007 |

* cited by examiner

*Primary Examiner* — Leonard R Leo
(74) *Attorney, Agent, or Firm* — Finnegan, Henderson, Farabow, Garrett & Dunner, L.L.P.

(57) ABSTRACT

An evaporator includes a hermetically sealed vessel 1A having an inlet 17 and an outlet 16, a refrigerant supply portion 14, in which liquid refrigerant is stored, a heat transfer portion 12, to which the liquid refrigerant stored in the refrigerant supply portion 14 is supplied, heat transfer fins 12A having a heat transfer surface provided in the heat transfer portion 12, a wick 13A provided on the heat transfer surface of the heat transfer fins 12A to transfer the liquid refrigerant supplied to the heat transfer portion 12 towards the outlet 16 by means of capillarity, and a heat radiation fins 15, which is provided on the outer surface of the refrigerant supply portion 14 to prevent the temperature of the refrigerant introduced into the refrigerant supply portion from rising.

3 Claims, 4 Drawing Sheets

EVAPORATOR AND CIRCULATION TYPE COOLING EQUIPMENT USING THE EVAPORATOR

CROSS-REFERENCE TO RELATED APPLICATIONS

This application is based upon and claims the benefit of priority from the prior Japanese Patent Application No. 2007-123459, filed on May 8, 2007; the entire contents of which are incorporated herein by reference.

BACKGROUND OF THE INVENTION

The present invention relates to an evaporator, which performs the cooling of electronic elements and/or electronic equipment, and to a circulation type cooling equipment using the evaporator.

As a semiconductor element used in various electronic equipments malfunctions due to high temperature, it is necessary to control the temperature under a certain level. For this reason, heat radiation is performed by means of heat spreader, heat-sink, fan and the like.

In recent years, it is getting difficult to secure a space where a heat-sink can be provided around the semiconductor element in such small electronic equipment as a note-PC. Therefore, a cooling system including refrigerant and a wick has been a mainstream, which removes the heat generated by the heat element as evaporating latent heat of the refrigerant and transferees it by means of heat pipe to the circumferential area of a casing, where a space for cooling can be easily available.

However, an amount of the transferable heat becomes intensively small as the diameter of the heat pipe becomes smaller. On the other hand, since the electronic equipments are getting more compact in size and higher in their performance, it will be difficult to realize enough cooling by means of heat pipe in future.

Further, in the case of the heat pipe, a flow direction of vapor generated at an evaporating portion and a flow direction of the refrigerant liquefied at a condensing portion, which is returned to the evaporating portion by means of capillarity of the wick are opposite to each other. For this reason, the liquid refrigerant is prevented from flowing in the wick by the vapor (This phenomenon is called as the scattering limit.) due to increases of the amount of the heat or to a decrease of a diameter of the heat pipe. It is another reason for limiting the amount of heat to be transferred that the flow resistance is large due to the wick, through which the refrigerant flows from the condensing portion to the evaporating portion (This phenomenon is called wick limitation.).

The technology that is developed as a replacement of the heat pipe is a Capillary Pumped Loop (hereinafter called as CPL), in which the heat pipe is formed in a loop. In the CPL different from the heat pipe described, there is no scattering limit since the flow direction of the vapor and the flow direction of the liquid returned from the condensing portion to the evaporating portion are coincident. Further, the wick limitation can be made small since there is no need to lay the wick all the way from the condensing portion to the evaporating portion. As the amount of the heat transferred can be made larger than in the heat pipe, this technology is already put into a practical use in the space application. One of such applications is described in Japan Published Unexamined Patent Application 2003-148882.

In the CPL, it is necessary to keep the flow direction of the vapor of the refrigerant in one direction. For this purpose, the Patent Application 2003-148882 proposes a technology to provide a liquid reservoir and hold the refrigerant by a non-return valve which selectively opens and closes depending on the temperature or by a filter.

However, the conventional technology described above are countermeasures against a counter flow of the refrigerant which has really taken place, but are not positive prevention against possible generation of vapor at the evaporating portion, which is a cause of the counter flow of refrigerant. Furthermore, there has been a problem that many materials were necessary to prevent the counter flow.

BRIEF SUMMARY OF THE INVENTION

Considering the problem in conventional technologies, it is one of objects of the present invention to provide an evaporator and a CPL using the evaporator enabling to prevent the vapor from generating on a liquid pipe side of the evaporator, which is a cause for a counter flow of the refrigerant without using devices such as a non-return valve or a filter.

An evaporator according to an embodiment of the invention includes a hermetically sealed vessel having an inlet to be connected to a liquid pipe and an outlet to be connected to an evaporating pipe, a refrigerant supply portion provided in the hermetically sealed vessel, in which liquid refrigerant flowing from the liquid pipe is stored, a heat transfer portion provided in the hermetically sealed vessel, to which the liquid refrigerant stored in the refrigerant supply portion is supplied, heat transfer fins having a heat transfer surface provided in the heat transfer portion, a wick provided on the heat transfer surface of the fins to transfer the liquid refrigerant supplied to the heat transfer portion towards the outlet by means of capillarity, in which the liquid refrigerant is vaporized by the heat introduced from an outside heat generating body into the heat transfer portion; and a refrigerant cooling portion, which is provided on the outer surface of the refrigerant supply portion to prevent the temperature of the refrigerant introduced into the refrigerant supply portion from rising.

A CPL according to an embodiment of the invention includes an evaporator which is so coupled with a heat generating body as to enable heat transfer and remove the heat from the heat generating body as evaporating latent heat of the refrigerant contained therein, a vapor pipe which transfers the vapor of the refrigerant generated by the evaporator, a condenser which cools and liquefies the refrigerant vapor supplied by the vapor pipe, a liquid pipe which transfers the liquefied refrigerant by the condenser to the evaporator.

The evaporator further includes a hermetically sealed vessel having an inlet to be connected to a liquid pipe and an outlet to be connected to an evaporating pipe; a refrigerant supply portion provided in the hermetically sealed vessel, in which liquid refrigerant flowing from the liquid pipe is stored, a heat transfer portion provided in the hermetically sealed vessel, to which the liquid refrigerant stored in the refrigerant supply portion is supplied; heat transfer fins having a heat transfer surface provided in the heat transfer portion, a wick provided on the heat transfer surface of the fins to transfer the liquid refrigerant supplied to the heat transfer portion towards the outlet by means of capillarity, in which the liquid refrigerant is vaporized by the heat introduced from an outside heat generating body into the heat transfer portion, and a refrigerant cooling portion, which is provided on the outer surface of the refrigerant supply portion to prevent the temperature of the refrigerant introduced into the refrigerant supply portion from rising.

An evaporator according to another embodiment of the invention includes a hermetically sealed vessel having an inlet to be connected to a liquid pipe and an outlet to be connected to an evaporating pipe, a refrigerant supply portion provided in the hermetically sealed vessel, in which liquid refrigerant flowing from the liquid pipe is stored, a heat transfer portion provided in the hermetically sealed vessel, to which the liquid refrigerant stored in the refrigerant supply portion is supplied, heat transfer fins having a heat transfer surface provided in the heat transfer portion, a wick in a form of a plate provided on the heat transfer surface of the fins to transfer the liquid refrigerant supplied to the heat transfer portion towards the outlet by means of capillarity, in which the liquid refrigerant is vaporized by the heat introduced from an outside heat generating body into the heat transfer portion, and a heat insulating member provided on a bottom of the refrigerant supply portion provided on the outer surface of the refrigerant supply portion to suppress the temperature rise of the refrigerant introduced into the refrigerant supply portion.

DETAILED DESCRIPTION OF THE INVENTION

The embodiments of the present invention are explained hereinafter with reference to the drawings accompanied.

Embodiment 1

Figure 1:
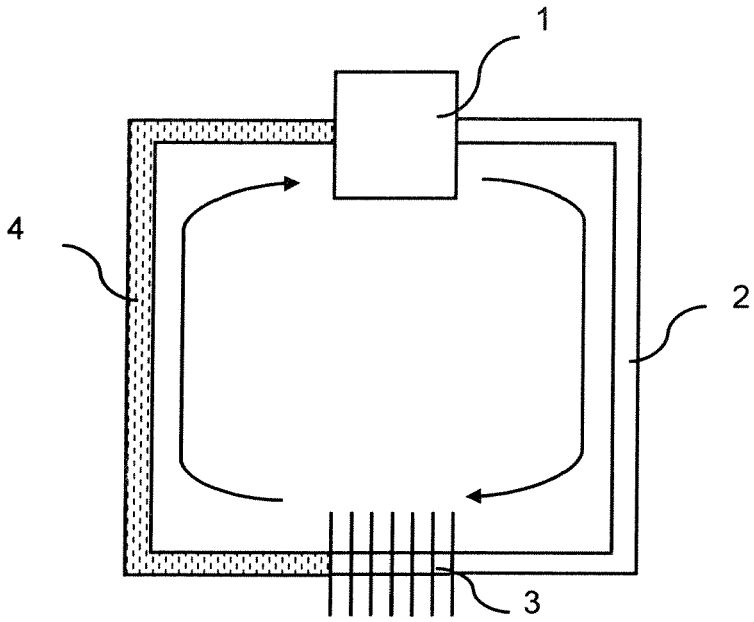
FIG. 1 is a schematic drawing of a capillary pumped loop according to the first embodiment of the present invention.

FIG. 1 is a schematic drawing of the capillary pumped loop according to a first embodiment of the present invention, in which arrows indicate flow directions of the refrigerant. The capillary pumped loop is composed of a evaporator 1, a vapor pipe 2, a condenser 3 and a liquid pipe 4, which are connected with each other in a closed loop. The evaporator 1 is coupled to a heat generating body (not shown) to enable heat transferring and to remove the heat contained in the heat generating body as evaporating latent heat of the refrigerant.

The vapor pipe 2 is a pipe connecting the evaporator 1 with the condenser 3. The refrigerant vapor generated in the evaporator 1 flows in the vapor pipe 2 in the direction to the condenser 3. Water, nonfreezing fluid, alcohol, ethanol, ammonia or chlorofluorocarbon-replacing material and the like can be utilized as the refrigerant.

The condenser 3 is such a device as a heat-sink with fins, which liquefies the vapor generated in the evaporator 1.

The liquid pipe 4 is a pipe connecting the evaporator 1 with the condenser 3, in which the refrigerant liquefied in the condenser 3 flows in the direction towards the evaporator 1.

Stainless steel such as SUS is used for manufacturing these pipes.

Figure 2:
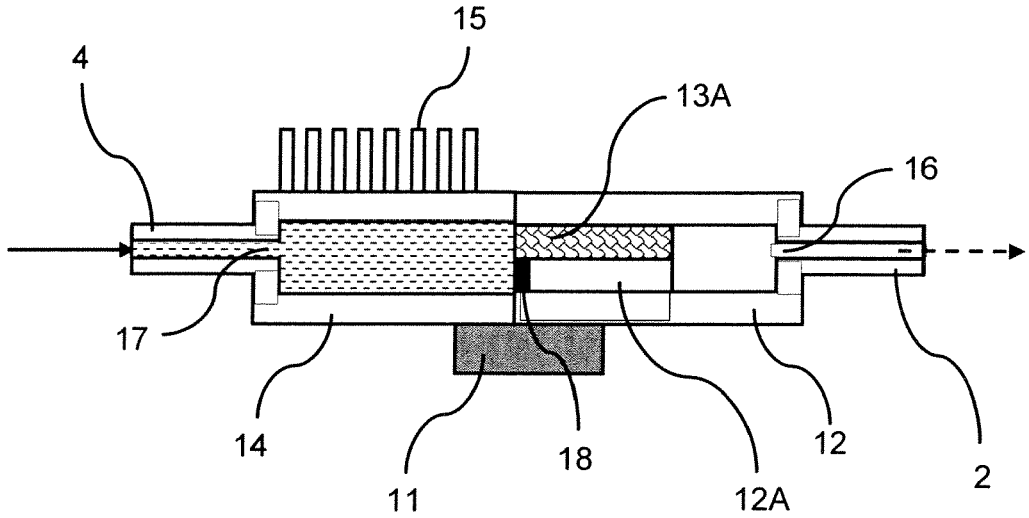
FIG. 2 is a sectional view of an evaporator included in the capillary pumped loop shown in FIG. 1.
Figure 3:
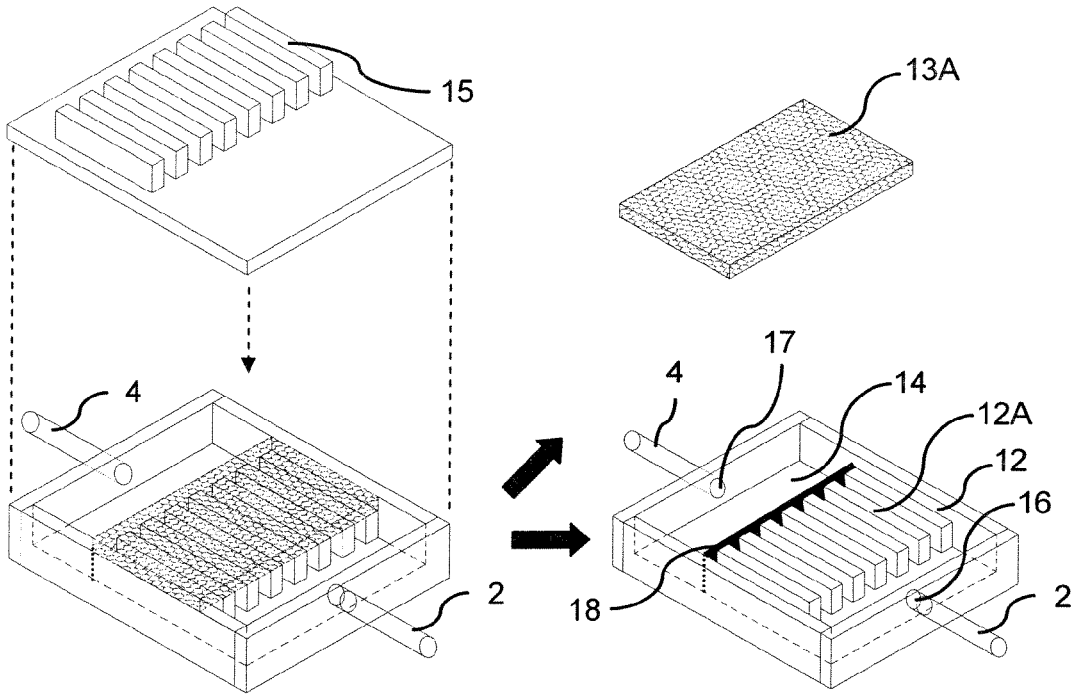
FIG. 3 is an exploded perspective view showing an inner structure of the evaporator included in the capillary pumped loop shown in FIG. 1.

FIG. 2 is a sectional view of an evaporator included in the capillary pumped loop shown in FIG. 1. In the drawing the arrow with a solid line shows a flow direction of the liquefied refrigerant and the arrows with a broken line shows a flow direction of refrigerant vapor. Further, FIG. 3 is an exploded perspective view showing an inner structure of the evaporator shown in FIG. 2.

The evaporator 1 is enclosed in a box-type hermetically sealed vessel 1A made of such a metal as aluminum, copper, or any alloy of these metals etc, which is superior in heat conductivity. The vessel 1A includes a heat transfer portion 12 on the side of the vapor pipe 2 and the refrigerant supply portion 14 on the side of liquid pipe 4.

The heat transfer portion 12 is a space provided on the side of the vapor pipe 2 in the hermetically sealed vessel 1A and is provided with an outlet 16, which is an opening for delivering the vapor to the vapor pipe 2. The heat transfer portion 12 is provided with a plurality of heat transfer fins 12A protruded upward from a bottom surface.

A wick 13A in a form of a plate is placed in contact with a heat transfer surface formed by top surfaces of the plurality of heat transfer fins 12A. The wick 13A is made of a sintered metal of copper, aluminum, carbon etc. or of porous material made of a high molecular resin such as urethane rubber and the like. The wick 13*a* extends its one end into the refrigerant supply portion 14 and slowly conveys the refrigerant in the refrigerant supply portion 14 to the heat transfer portion 12 by means of capillarity.

A semiconductor element 11 is provided on a lower surface of the outer wall of the heat transfer portion 12, so as to enable to transfer the heat generated by the semiconductor element 11. The heat generated by the semiconductor element 11 is thus transferred to the refrigerant in the wick 13A through the heat transfer fins 12A provided in the heat transfer portion 12. As a result, the refrigerant changes its phase from liquid to vapor, which flows into the vapor pipe 2 through spaces between the heat transfer fins.

On the other hand, the refrigerant supply portion 14 is a space provided on the side of the liquid pipe 4 in the hermetically sealed vessel 1A and is provided with an inlet 17, which is an opening for introducing the liquid refrigerant from the liquid pipe 4. The refrigerant supply portion 14 stores the refrigerant flowing from the liquid pipe 4 and supplies the liquid refrigerant to the heat transfer portion 12 through the wick 13A by means of capillarity.

Here, an intercept plate 18 is provided between the refrigerant supply portion 14 and the heat transfer portion 12, so that the refrigerant may not flow into the heat transfer portion without passing through the wick 13A. The refrigerant supply portion 14 and the heat transfer portion are formed integrally in view of manufacturing costs and making the device compact.

Heat radiation fins 15A are provided on a portion of an outer wall of the refrigerant supply portion 14 so as to prevent the temperature of the refrigerant in the refrigerant supply portion 14 from increasing.

Next, an operation of the evaporator 1 described above is explained.

When the semi-conductor element 11 generates heat, the heat is transferred to the heat transfer portion 12. The heat generated by the semiconductor element 11 is thus transferred to the refrigerant in the wick 13A through the heat transfer fins 12A provided in the heat transfer portion 12. As a result, the refrigerant changes its phase from liquid to vapor, which flows into the vapor pipe 2 through spaces between the heat transfer fins.

On the other hand, when the semi-conductor element 11 generates heat, the heat is transferred from the heat transfer portion 12 to the refrigerant supply portion 14 since the heat transfer portion 12 and the refrigerant supply portion 14 are formed integrally. When the refrigerant in the refrigerant supply portion 14 reaches to a certain temperature, vapor is generated. At this moment, the heat generated in the semiconductor element 11 moves to the refrigerant as the vaporizing latent heat of the refrigerant. This refrigerant vapor flows in the vapor pipe 2 towards the condenser 3. The condenser 3 cools down the refrigerant vapor flowing through the vapor pipe 2 into liquid refrigerant. The liquid refrigerant then flows toward the evaporator portion 1 through the liquid pipe 4. Then the liquid refrigerant flows through the inlet 17 into the refrigerant supply portion 14.

Here, generation of the vapor at the refrigerant supply portion 14 is suppressed since the temperature of the refrigerant in the refrigerant supply portion 14 is prevented from increasing by the heat radiation fins 15. It is avoided that the vapor generated in the refrigerant supply portion 14 closes the inlet 17 of the refrigerant supply portion 14 thereby intercepting the flow of the refrigerant into the refrigerant supply 14 and further to the wick 13A.

As it has been described, the phenomenon is prevented from occurring that the counter flow of the vapor disturbs the flow of the refrigerant into the refrigerant supply portion 14. The circulation of the refrigerant is thus performed smoothly, even if the component such as a non-return valve or a filter is not installed.

Further, the evaporator 1 has simple structure as described above and is easy to manufacture and to make it in compact size.

Embodiment 2

Figure 4:
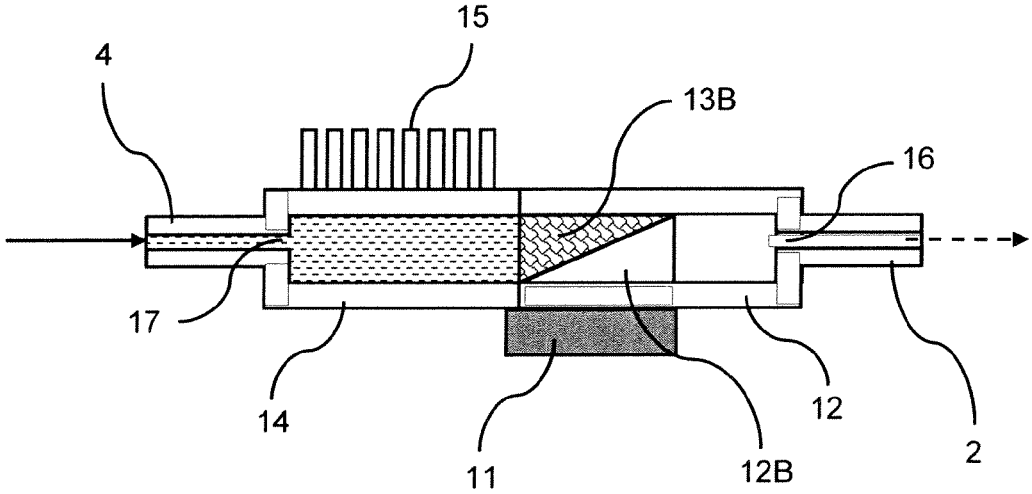
FIG. 4 is a sectional view of an evaporator included in the capillary pumped loop according to the second embodiment of the present invention.
Figure 5:
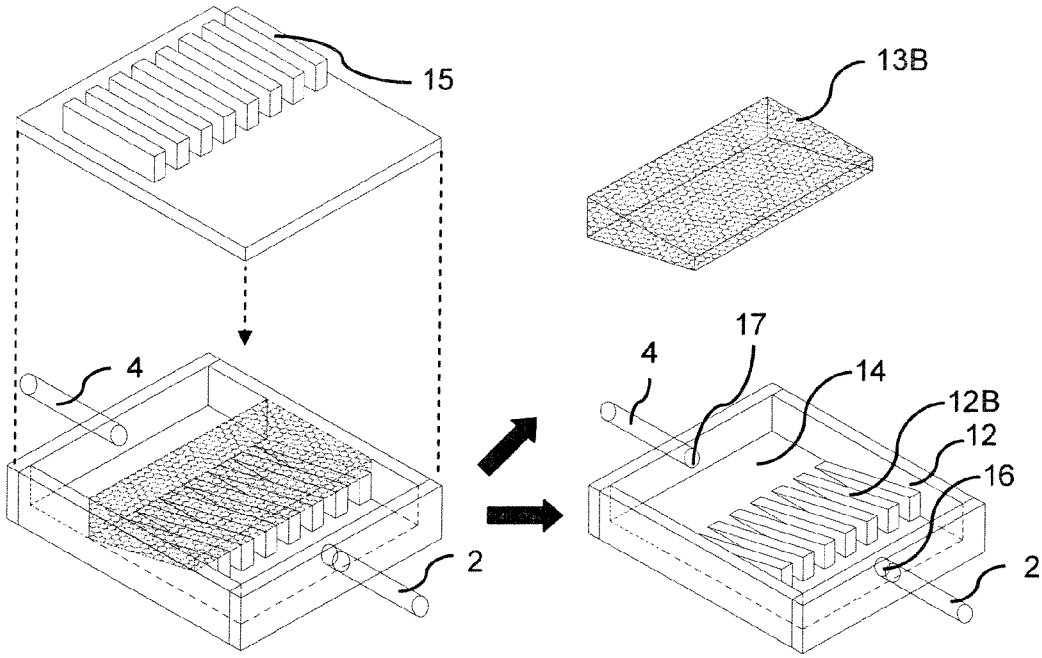
FIG. 5 is an exploded perspective view showing an inner structure of the evaporator shown in FIG. 4.

FIG. 4 is a sectional view of an evaporator included in the capillary pumped loop according to the second embodiment of the present invention. FIG. 5 is an exploded perspective view showing an inner structure of the evaporator shown in FIG. 4.

Here, the capillary pumped loop according to the embodiment is different from that according to the first embodiment only in the structure of the evaporator. Thus the symbols common to those in FIG. 2 shall indicate the same parts. Therefore, in the following description, the portions different from the first embodiment will be mainly explained and the detailed explanation on the same portions will be omitted.

In the heat transfer portion 12 according to the second embodiment, a plurality of the heat radiation fins 12 having a triangle form are so arranged in parallel on the bottom surface of the evaporator that the height of the fins increases as approaches to the outlet of the heat transfer portion 16. Further, the heat transfer side of the wick is formed to be inclined in accordance with the form of the heat transfer portion 12, so that it may tightly contact with the upper surface of the heat transfer fins. In other words, the wick 13B becomes thinner as it approaches to the outlet of the heat transfer portion 16 from the side of the refrigerant supply portion, so that the bottom surface of the wick 13B inclines against the upper surface of the heat transfer fins 12B. In this connection, the end surface of the wick 13B on the side of refrigerant supply portion 14 functions as the intercept material against the refrigerant supply portion 14.

Further, in this embodiment, the semiconductor element 11, which is the heat generating body, is located at a portion shifted to the heat transfer portion 12 on the outer bottom of the evaporator. The evaporation of the refrigerant on the side of the refrigerant supply portion 14 is suppressed more than on the side of the heat transfer portion 12.

As a heat transfer surface thus formed becomes larger than that in the first embodiment, there is an advantage that the heat can be transferred to the refrigerant effectively. There is another advantage that the vapor can flow more easily through the heat transfer fins, which are inclined upward as it approaches to the outlet of the heat transfer portion 16.

Embodiment 3

Figure 6:
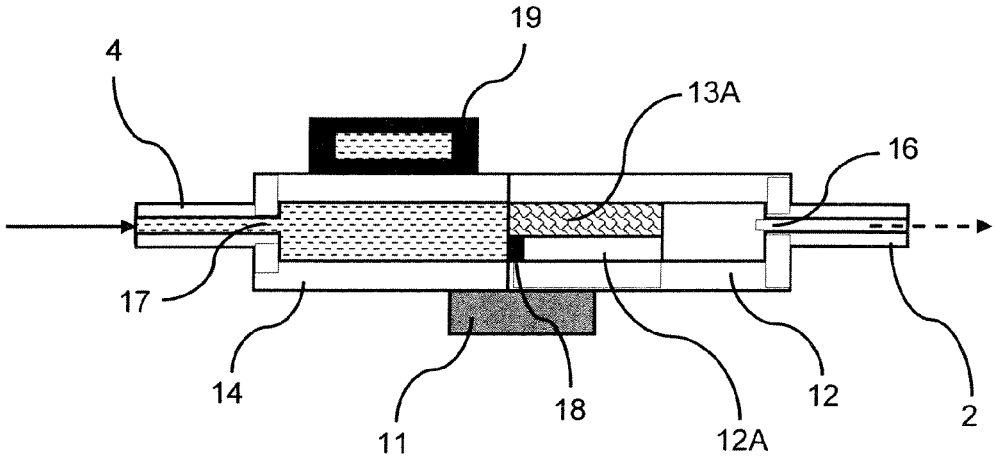
FIG. 6 is a sectional view of an evaporator included in the capillary pumped loop according to the third embodiment of the present invention.

FIG. 6 is a sectional view of an evaporator included in the capillary pumped loop according to the third embodiment of the present invention. In the embodiment, only a structure of the evaporator in the capillary pumped loop differs from that of the first embodiment, so that an explanation will be made with the evaporator hereinafter. Thus, the same symbols are allocated to the parts common to those in FIG. 2 and the detailed explanation of the same will be omitted.

In the evaporator according to the embodiment, a cooling element 19 is provided on the outer wall on the side of refrigerant supply portion 14 in place of the heat radiation fins 15 shown in FIG. 2. Thus, the temperature of the refrigerant in the refrigerant supply portion 14 is kept low. As the cooling element 19, for an example, a cooling pipe, in which a refrigerant flows, can be used. The cooling capacity can be improved compared to the heat radiation fins 15 by so coupling the cooling element 19 to the refrigerant supply portion 14 that the heat may be transferred. The location and the number of the cooling elements 19 to be mounted can be selected with flexibility since the cooling element 19 is not formed integrally with the evaporator 1.

Embodiment 4

Figure 7:
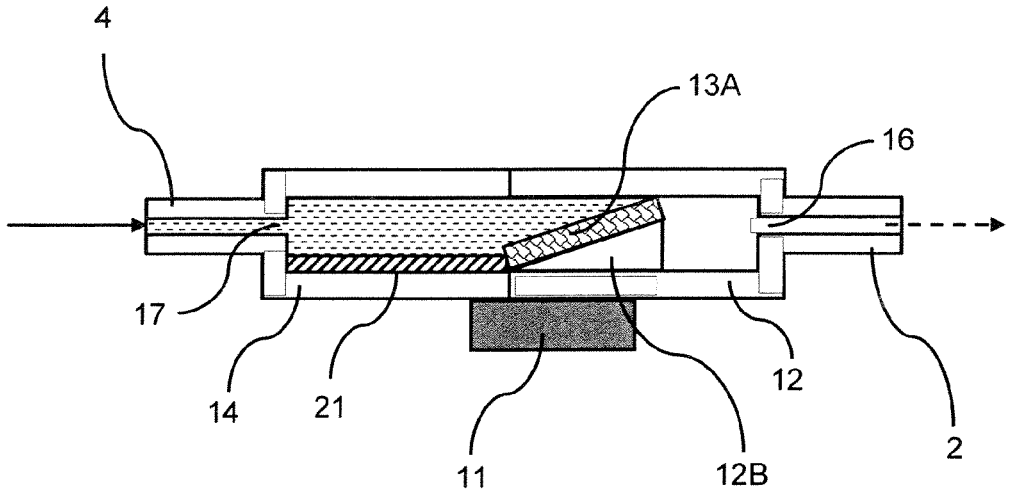
FIG. 7 is a sectional view of an evaporator included in the capillary pumped loop according to the fourth embodiment of the present invention.
Figure 8:
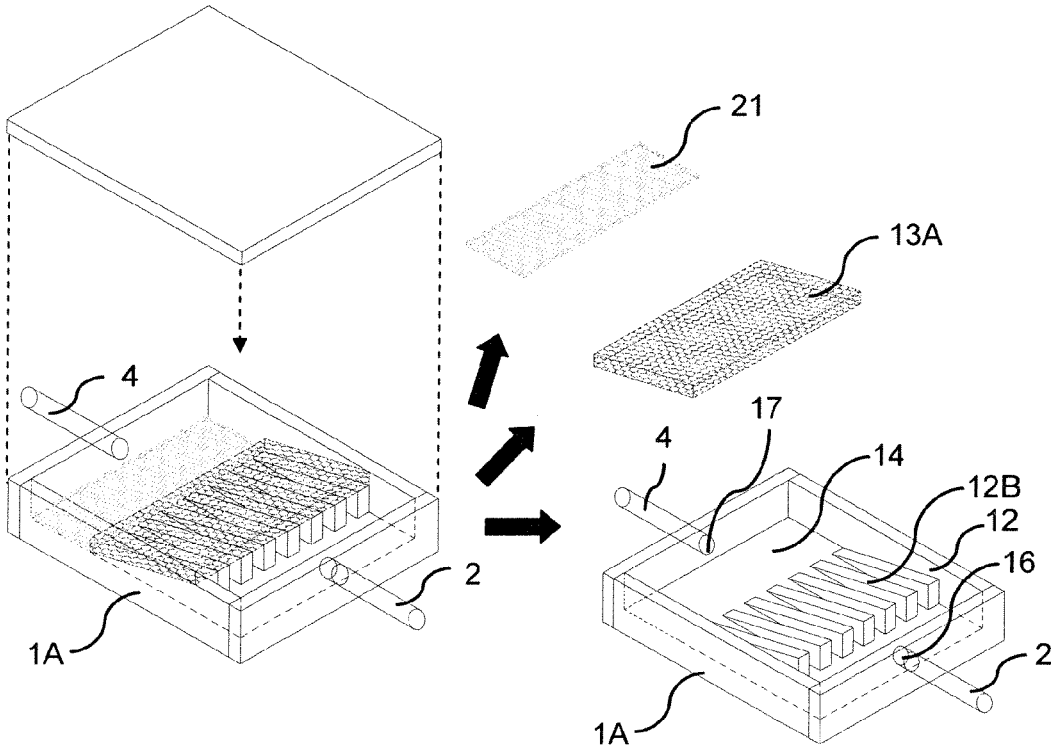
FIG. 8 is an exploded perspective view showing an inner structure of the evaporator shown in FIG. 7.

FIG. 7 is a sectional view of an evaporator included in the capillary pumped loop according to the fourth embodiment of the present invention. FIG. 8 is an exploded perspective view showing an inner structure of the evaporator shown in FIG. 7.

In the embodiment, only a structure of the evaporator in the capillary pumped loop differs from that of the first embodiment, so that an explanation will be made with the evaporator hereinafter. Thus, the same symbols are allocated to the parts common to those in FIG. 2, FIG. 3, FIG. 4 or FIG. 5 and detailed explanation of the same will be omitted.

In the evaporator according to the embodiment, a heat insulating member 21 is provided on a bottom of the refrigerant supply portion 14. The heat insulating member 21 is made of bakelite, glass fiber, or material, for example, thermal conductivities of which are lower than that of the metallic material forming the case of the evaporator 1A. Here, a flat wick 13 with a constant thickness over the entire surface is used as is the case with the wick 13 according to the first embodiment (FIG. 2, FIG. 3).

In the evaporator described above, the heat generated from the semiconductor element 11 is intercepted to transfer to the refrigerant in the refrigerant supply portion 14 by the heat insulating member 21 and thus the temperature rise in the refrigerant is suppressed. As the result, it is avoided that the vapor generated in the refrigerant supply portion 14 closes the inlet 17 of the refrigerant supply portion 14 thereby intercepting the flow of the refrigerant.

As it is not necessary to provide the evaporator with the heat radiation fins 15 or the cooling element 19 as shown in the first to third embodiments, the evaporator can be made more compact.

Furthermore, better heat exchange can be performed since a flat wick 13A is located on the heat transfer surface formed with the top surfaces of the plurality of inclined heat transfer fins in the evaporator, thereby providing a larger contact area of refrigerant with the wick 13A than the wick 13B shown in FIG. 4 or FIG. 5.

The present invention is not limited to the embodiments described above, and it is possible to modify the embodiments in the scope of the technical idea of the present invention. For example, the shape of the heat radiation fins 15 may be of a pin-type in place of a comb type as shown in FIG. 2. Further, the heat radiation fins 15 or the cooling element 19 is not necessarily located on the top of the refrigerant supply portion 14, but it may be located on the side wall, the lower surface or in the neighborhood of the inlet of the refrigerant supply portion 17. Furthermore, although the heat transfer portion 12 and the refrigerant supply portion 14 were integrally formed in view of the manufacturing costs and others, they may be separately made using different material and thereafter may be coupled with each other.

What is claimed is:

1. An evaporator for evaporating a refrigerant with heat generated by a heat generating body, comprising:

a hermetically sealed vessel having an inlet to be connected to a liquid pipe and an outlet to be connected to a vapor pipe;

a refrigerant supply portion provided in the hermetically sealed vessel, in which the refrigerant in a liquid state flowing from the liquid pipe is stored;

a heat transfer portion provided in the hermetically sealed vessel, to which the liquid refrigerant stored in the refrigerant supply portion is supplied;

heat transfer fins having a heat transfer surface provided in the heat transfer portion, which are so inclined that the heat transfer surface becomes higher on the side of the vapor pipe than on the side of the liquid pipe;

a wick provided on the heat transfer surface of the fins, which is formed thicker on the side of the liquid pipe than the vapor pipe side, to transfer the liquid refrigerant supplied to the heat transfer portion towards the outlet by means of capillarity, in which the liquid refrigerant is vaporized by the heat introduced from an outside heat generating body into the heat transfer portion; and a refrigerant cooling portion, which includes a plurality of heat radiation fins arranged in parallel on an outer surface of the refrigerant supply portion to prevent the temperature of the refrigerant introduced into the refrigerant supply portion from rising;

wherein a center of the heat transfer surface is positioned on the side of the vapor pipe with respect to a center of the hermetically sealed vessel.

2. A capillary pumped loop for refrigerating a heat generating body using a refrigerant, comprising:

an evaporator which is so coupled with a heat generating body as to enable heat transfer and remove the heat from the heat generating body as evaporating latent heat of the refrigerant contained therein;

a vapor pipe which transfers the vapor of the refrigerant generated by the evaporator;

a condenser which cools and liquefies the refrigerant vapor supplied by the vapor pipe; and a liquid pipe which transfers the liquefied refrigerant by the condenser to the evaporator; and the evaporator further comprises;

a hermetically sealed vessel having an inlet to be connected to a liquid pipe and an outlet to be connected to the vapor pipe, a refrigerant supply portion provided in the hermetically sealed vessel, in which the refrigerant in a liquid state flowing from the liquid pipe is stored, a heat transfer portion provided in the hermetically sealed vessel, to which the liquid refrigerant stored in the refrigerant supply portion is supplied, heat transfer fins having a heat transfer surface provided in the heat transfer portion, which are so inclined that the heat transfer surface becomes higher on the side of the vapor pipe than on the side of the liquid pipe, a wick provided on the heat transfer surface of the fins, which is formed thicker on the side of the liquid pipe than the vapor pipe side, to transfer the liquid refrigerant supplied to the heat transfer portion towards the outlet by means of capillarity, in which the liquid refrigerant is vaporized by the heat introduced from an outside heat generating body into the heat transfer portion, and a refrigerant cooling portion, which includes a plurality of heat radiation fins arranged in parallel on an outer surface of the refrigerant supply portion to prevent the temperature of the refrigerant introduced into the refrigerant supply portion from rising;

wherein a center of the heat transfer surface is positioned on the side of the vapor pipe with respect to a center of the hermetically sealed vessel.

3. An evaporator for evaporating a refrigerant with heat generated by a heat generating body, comprising:

a hermetically sealed vessel having an inlet to be connected to a liquid pipe and an outlet to be connected to a vapor pipe;

a refrigerant supply portion provided in the hermetically sealed vessel, in which the refrigerant in a liquid state flowing from the liquid pipe is stored;

a heat transfer portion provided in the hermetically sealed vessel, to which the liquid refrigerant stored in the refrigerant supply portion is supplied;

heat transfer fins having a heat transfer surface provided in the heat transfer portion, which are so inclined that the heat transfer surface becomes higher on the side of the vapor pipe than on the side of the liquid pipe;

a wick in a form of a plate provided on the heat transfer surface of the fins, which is formed thicker on the side of the liquid pipe than the vapor pipe side, to transfer the liquid refrigerant supplied to the heat transfer portion towards the outlet by means of capillarity, in which the liquid refrigerant is vaporized by the heat introduced from an outside heat generating body into the heat transfer portion; and a heat insulating member provided on a bottom of the refrigerant supply portion provided on the outer surface of the refrigerant supply portion to suppress the temperature rise of the refrigerant introduced into the refrigerant supply portion; and a refrigerant cooling portion, which includes a plurality of heat radiation fins arranged in parallel on an outer surface of the refrigerant supply portion to prevent the temperature of the refrigerant introduced into the refrigerant supply portion from rising;

wherein a center of the heat transfer surface is positioned on the side of the vapor pipe with respect to a center of the hermetically sealed vessel.

* * * * *